US007658227B2

(12) United States Patent
Fox et al.

(10) Patent No.: US 7,658,227 B2
(45) Date of Patent: Feb. 9, 2010

(54) SYSTEM AND METHOD FOR SENSING FLOW RATE AND SPECIFIC GRAVITY WITHIN A WELLBORE

(75) Inventors: Michael J. Fox, Claremore, OK (US); Ernesto Alejandro Vilcinskas, Claremore, OK (US); Howard G. Thompson, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/108,918

(22) Filed: Apr. 24, 2008

(65) Prior Publication Data

US 2009/0266536 A1 Oct. 29, 2009

(51) Int. Cl.
*E21B 47/00* (2006.01)

(52) U.S. Cl. ..... 166/250.01; 166/252.5; 73/152.31

(58) Field of Classification Search ..... 166/250.1, 166/250.07, 252.5; 73/152.18, 152.29, 152.31, 73/152.32–152.35

See application file for complete search history.

(56) References Cited

U.S. PATENT DOCUMENTS

| | | | | |
|---|---|---|---|---|
| 5,975,842 | A | 11/1999 | Jensen et al. | |
| 6,167,965 | B1 | 1/2001 | Bearden et al. | |
| 6,299,349 | B1 | 10/2001 | Steinel et al. | |
| 6,585,041 | B2 * | 7/2003 | Crossley | 166/53 |
| 6,629,564 | B1 | 10/2003 | Ramakrishnan et al. | |
| 6,811,382 | B2 * | 11/2004 | Buchanan et al. | 417/244 |
| 7,021,375 | B2 | 4/2006 | Ringgenberg | |
| 2007/0114040 | A1 | 5/2007 | Jamieson et al. | |
| 2007/0169933 | A1 | 7/2007 | Heller et al. | |

* cited by examiner

*Primary Examiner*—David J Bagnell
*Assistant Examiner*—Elizabeth C Gottlieb
(74) *Attorney, Agent, or Firm*—Bracewell & Giuliani LLP

(57) ABSTRACT

A device determines the specific gravity of a wellbore fluid flowing into a submersible pump. The specific gravity of the wellbore fluid is determined by measuring the pressure increase across at least two pump stages and then using fluid flow properties and known pump characteristics to back calculate the specific gravity of the wellbore fluid.

20 Claims, 5 Drawing Sheets

SYSTEM AND METHOD FOR SENSING FLOW RATE AND SPECIFIC GRAVITY WITHIN A WELLBORE

TECHNICAL FIELD OF THE INVENTION

The present invention generally relates to a system and methodology for determining parameters in a wellbore. Specifically, the invention is a device that determines both fluid flow and specific gravity (or density) of the fluid going into an electric submersible pump (ESP) based upon measured pressure increases.

BACKGROUND OF THE INVENTION

It is very beneficial to be able to independently control production from each one of multiple zones of a well. For example, when water begins to be produced from a particular zone, it may be desired to cease production from that zone, while still producing from other zones of the well. As another example, when gas begins to be produced from a particular zone, it may be desired to decrease production from that zone, while still producing from other zones of the well. As a further example, rates of production from various zones may be independently regulated to maximize overall production from a reservoir.

However, in order to accurately determine the particular zones to regulate production from, and the manner in which production from those zones should be regulated, a well operator needs to be able to determine what fluids, and what quantities of those fluids, are being produced from each zone. Prior methods of making these determinations have relied on use of wireline conveyed tools. However, use of these tools usually requires that the well be shut in and that an intervention be made into the well.

It would be far more convenient and useful to be able to continuously monitor what fluids, and what quantities of those fluids, are being produced from each zone of a well. It is accordingly one of the objects of the present invention to provide fluid property sensors for relatively permanent installation in a well, and methods of using and calibrating those sensors.

An electric submersible pumping system generally is formed as an electric submersible pump string having at least three main component sections. The sections comprise a three-phase motor, pump stages, and a motor protector generally located between the motor and the pump stages. In a typical arrangement, the motor is located below the pump stages within the wellbore. Historically, measurement of parameters within the well was constrained to sensors located below the motor. For example, certain existing electric submersible pump string sensor systems utilize a sensing unit connected at the bottom of the submersible motor.

Attempts have been made to collect data from locations along the electric submersible pump string on various parameters. For example, a complete transducer has been attached to the side of the pump string by clamps or gauge carriers. In other attempts, a pressure line has been routed from a location along the pump string to a pressure sensor in a unit mounted below the motor. Also, sensors have been attached to the outside of the pump string and coupled to a dedicated electrical or fiber optic line run from a surface location. However, none of these approaches has succeeded in providing a rugged system of sensors for integration into an electric submersible pump string, and therefore, they all fail to provide accurate, real time data to the operator at the surface.

SUMMARY OF THE INVENTION

The present invention is directed to a process that satisfies at least one of these needs. One embodiment of the present invention provides for a method for determining wellbore parameters of a wellbore fluid flowing into a submersible pump having a plurality of pump stages. The embodiment generally includes measuring a first pressure increase across a first pump stage of the submersible pump, measuring a second pressure increase across a second pump stage of the submersible pump, calculating a pressure increase ratio wherein the pressure increase ratio is a ratio of the first pressure increase over the second pressure increase, determining a flow rate based upon the pressure increase ratio, determining a head of a selected one of the first and second pump stage based upon the flow rate, and finally calculating a specific gravity of the wellbore fluid using the determined head and the pressure increase of the selected one of the first and second pump stage. Preferably, the wellbore fluid is substantially free of free gas.

In one embodiment, the first and second pump stages are centrifugal pump stages. In another embodiment, the respective pump stages are rated for different flow rates. For example, the first pump stage could be rated for a flow rate of 11000 barrels per day, while the second pump stage could be rated for 3000 barrels per day, or vice versa. In a preferred embodiment, the step of determining the flow rate comprises constructing a pump curve of flow rate versus head ratio for a plurality of pump sizes, and using the calculated pressure increase ratio to determine the flow rate of the wellbore fluid based upon the pump curve of flow rate versus head ratio, wherein the pressure increase ratio and head ratio are equivalent.

In another embodiment, a user must first obtain a pump curve of head versus flow rate for an identified pump in order to determine the head of a selected one of the first and second pump stages based upon the flow rate. In a preferred embodiment, the identified pump is identical to the one used in either the first pump stage or the second pump stage. Preferably, the pumps used in each of the stages are strategically selected such that the pressure ratio at various given flow rates yields a pump curve of flow rate versus pressure increase ratio with a sufficiently distinguishing plot line. A sufficiently distinguishing plot line is one that has a relatively high slope such that small changes in the pressure increase ratio yield a larger change in the flow rate. Preferably, the slope is at an angle between about 20 degrees to about 70 degrees from horizontal, and more preferably about 3 5 degrees to about 55 degrees from horizontal, and most preferably about 45 degrees from horizontal.

In one embodiment, the method includes taking pressure measurements at various points within the submersible pump. For example, the pressure measurements can be taken at the inlet and outlet of each of the pump stages, thereby allowing a user to calculate the pressure increase across any given stage simply by finding the pressure difference between the inlet and outlet of each stage.

In another embodiment, the method further includes determining the viscosity of the wellbore fluid. In a further embodiment, the viscosity of the wellbore fluid is determined according to methods known by those skilled in the art. For example, the viscosity may be determined by measuring the viscosity of the fluid at the surface, and then using known fluid characteristics and downhole temperatures, the user may determine what the viscosity would be downhole at the submersible pump.

The present invention is also drawn to a device for measuring parameters within a wellbore comprising an electric submersible pump (ESP). In one embodiment, the ESP comprises a pump member, at least three pressure sensors, a receiver, and a program.

In a further embodiment of the present invention, the pump member has an inlet for receiving fluid and an outlet for discharging fluid, and is disposed within the wellbore. The pump member also has at least two pump stages, wherein each pump stage includes a moveable member for moving said fluids. In a preferred embodiment, the moveable member is a rotatable impeller.

In a preferred embodiment, the at least three pressure sensors are placed such that the three pressure sensors, in combination with each other, are operable to measure the pressure increase before and after each of the two pump stages. In one embodiment of the present invention, a receiver is communicatively coupled to the pressure sensors. In a further embodiment, the receiver is located at the surface of the wellbore. In another embodiment of the present invention, a program is composed of instructions, executable by the receiver, for receiving data from the three pressure sensors and calculating the specific gravity of fluids within the wellbore based upon relationships of the pressure increases across each of the two pump stages. The program can also have access to stored pump-characteristic data such that the program can determine the specific gravity of the wellbore fluid using pump curve data as described above.

In a preferred embodiment, the device further comprises an electrically-powered motor located in a remote downhole location within the wellbore, with the motor being mechanically coupled to the moveable member of each pump stage. In one embodiment, the motor is mechanically coupled to the moveable member by a shaft. Furthermore, the device may include an electrical conductor member extending from a remote surface location to the ESP for providing electrical power to the electrically-powered motor. Additionally, the electrical conductor member can also be used to transmit data from the three pressure sensors by superimposing the signals from the three pressure sensors.

In a preferred embodiment of the present invention, the two pump stages further comprise a diffuser. Furthermore, the device can further comprise three or more spacer sleeves, wherein the three or more spacer sleeves are positioned within the ESP such that the three or more spacer sleeves are, in combination with each other, operable to fixedly attach the three pressure sensors,

BRIEF DESCRIPTION OF THE DRAWINGS

So that the manner in which the above-recited features, advantages, and objectives of the invention, as well as others that will become apparent, are attained and can be understood in detail, more particular description of the invention briefly summarized above may be had by reference to the embodiments thereof that are illustrated in the drawings that form a part of this specification. It is to be noted, however, that the appended drawings illustrate only several embodiments of the invention and are, therefore, not to be considered limiting of the invention's scope, for the invention may admit to other equally effective embodiments.

DETAILED DESCRIPTION

Figure 1:
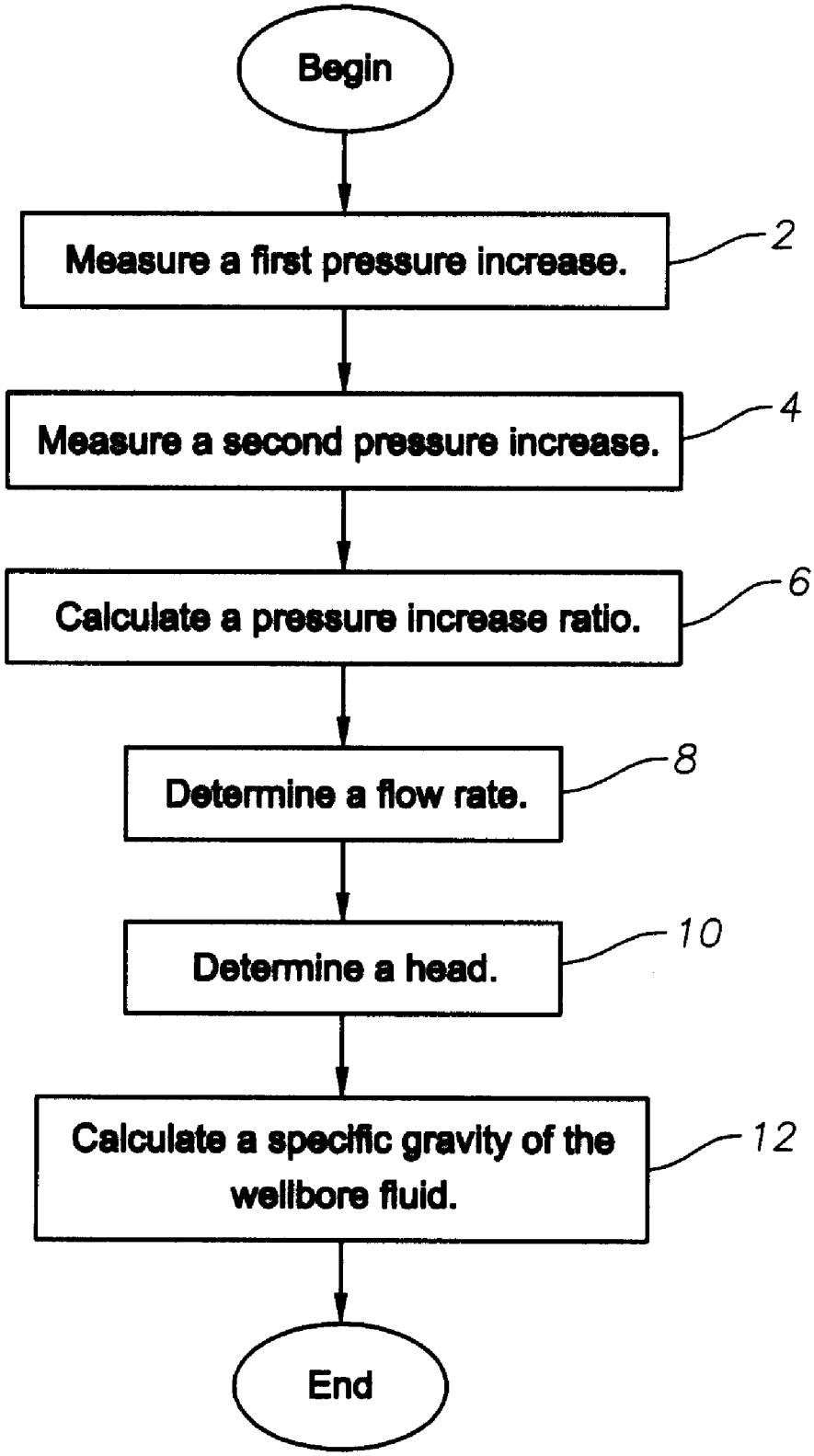
FIG. 1 is a flowchart in accordance with an embodiment of the present invention.

The present invention provides both a method and a device to measure both the flow rate and specific gravity of a wellbore fluid as it enters a submersible pump. Now turning to FIG. 1, which represents an embodiment of the present invention. The user must measure a first and second pressure increase [2, 4] across two or more pump stages of a centrifugal pump. While these steps are shown sequentially in FIG. 1, one skilled in the art should recognize that the order of measuring is nondeterminative. It is only important that at least two pressure increases are measured, such that the user may then calculate a pressure increase ratio [6]. Once the pressure increase ratio is calculated, the user may then determine the flow rate [8] using pump characteristics. After determining the flow rate, the user may then determine a head [10] for one of the pump stages used. Once the head is determined, the user may finally calculate the specific gravity of the wellbore fluid [ 12] using fluid flow equations.

Figure 2:
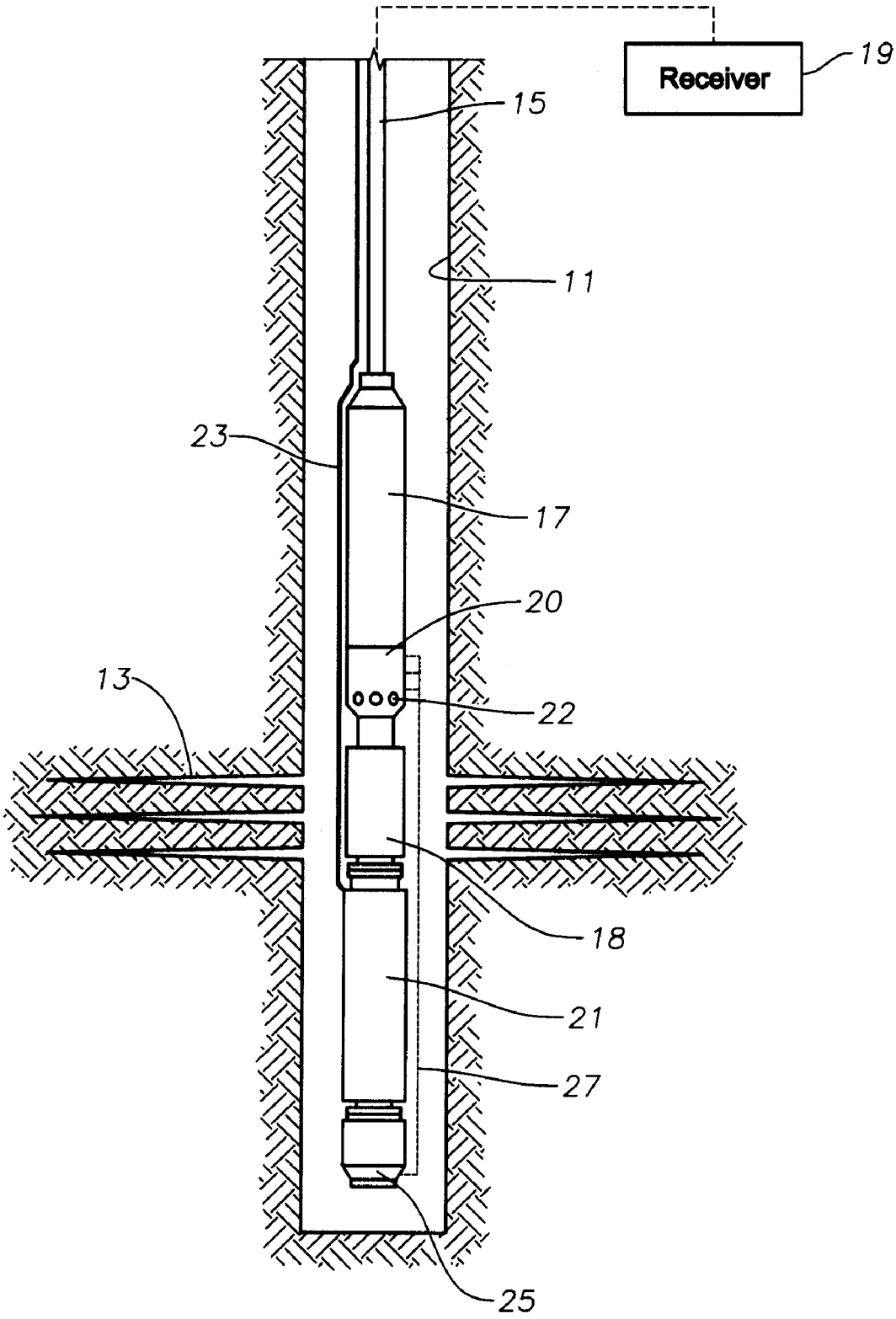
FIG. 2 is a schematic view of a well containing an electrical submersible pump assembly in accordance with an embodiment of the present invention.

Referring to FIG. 2, well [11] is a cased well having a set of producing formation perforations [13]. Perforations [13] provide a path for fluid contained in the earth formation to flow into well [11]. A string of tubing [15] extends from the surface into the well. Primary pump stages [17] are supported on the lower end of tubing [15]. Primary pump stages [17] are of a centrifugal type, having a number of stages for pumping fluids contained within well [11]. The outlet or discharge of primary pump stages [17] connects to the tubing [15]. Fluid inlets [22] are located at the lower end of special pump housing section [20] for drawing in wellbore fluid flowing from perforations [13]. Pump housing section [20] could be an integral part of primary pump stages [17], rather than a separate housing.

Special pump housing section [20] is shown connected to a seal section [18] for a three-phase alternating current motor [21], which has a shaft that will drive primary pump stages [17], as well as pump stages within special pump housing section [20]. Seal section [18] is located at the upper end of motor [21] to seal the lubricant within motor [21] and may be considered a part of the electric motor assembly. Seal section [18] also equalizes pressure of motor lubricant with the hydrostatic pressure of the exterior. Seal section [18] may also have a thrust bearing for handling downthrust created by primary pump stages [17]. Power cable [23] extends from the surface to motor [21] for supplying electrical power. The output shaft (not shown) of seal section [18] will drive primary pump stages [17] and the secondary pump stages (not shown) located within special pump housing section [20]. Electrical line [27] connects each pressure sensor to an additional temperature pressure sensor [25] mounted at the bottom of motor [21]. In one embodiment, receiver [19] is located at the surface and is in communication with the pressure sensors located within special pump housing section [20] and the pressure and temperature sensor connected to the bottom of motor [21].

In one embodiment, a program is composed of instructions and is in communication with receiver [19], such that receiver [19] is operable to receive data from the three pressure sensors within special pump housing section [20] as well as the temperature and pressure sensor connected to the bottom of motor [21], and to execute the program in order to calculate the specific gravity of the fluids within the wellbore based upon the received pressure increase data. The program preferably has stored pump-characteristic data such that the program can iteratively determine the specific gravity of the wellbore fluid.

Figure 3:
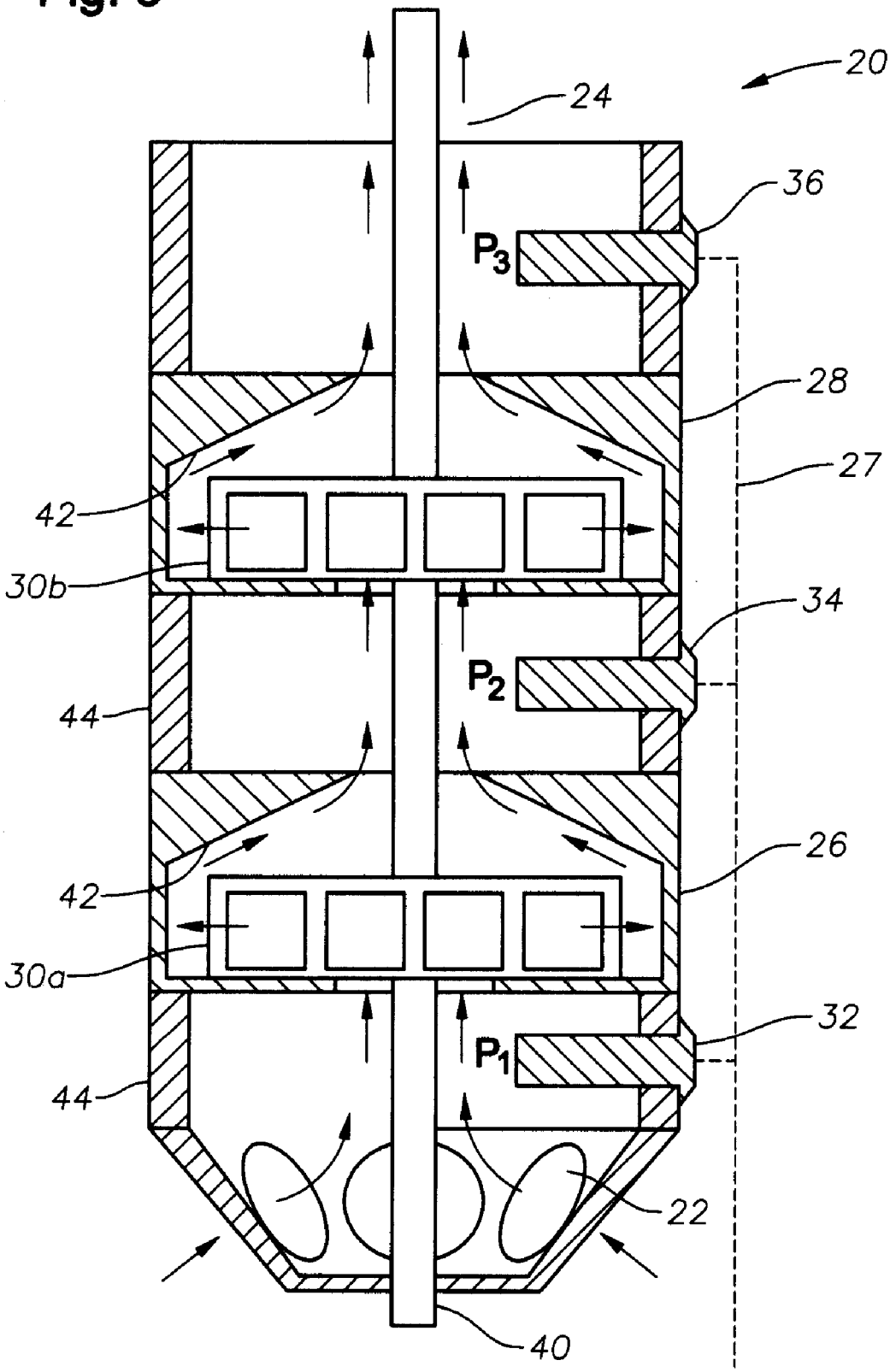
FIG. 3 is a cross-sectional view of a portion of the pump assembly of FIG. 2, showing two pump stages at the inlet of the pump.

Motor [21] typically can be driven by the frequency of the power supplied to rotate in the range from 2,400 to 4,800 rpm. The power supplied can be at a fixed frequency or it can be varied, FIG. 3 displays a more detailed, but schematic, view of one embodiment of special pump housing section [20]. In a preferred embodiment, special pump housing section [20] has two pump stages [26, 28]; however, more pump stages can be employed. In one embodiment of the present invention, three pressure sensors [32, 34, 36] are used in order to measure the pressure at points before and after each pump stage. Therefore, in a preferred embodiment, if there are two pump stages, then the device would preferably have three pressure sensors. However, one skilled in the art should recognize other methods for measuring the pressure increase across the pump stages.

Wellbore fluid enters special pump housing section [20] at fluid inlets [22] and travels upwards where the fluid's first pressure is measured by first pressure sensor [32]. The fluid continues past first pressure sensor [32] and into first pump stage [26], where the pressure of the fluid is increased through first rotatable member [30*a*]. In a preferred embodiment, first rotatable member [30*a*] is a centrifugal impeller. The fluid, which was traveling substantially vertically prior to entering first pump stage [26], exits first rotatable member [30*a*] at least partially radially. In the embodiment shown in FIG. 3, the flow is predominately radial; however, in other embodiments the flow could be mixed radial and axial flow types. The fluid is then guided by diffuser [42] such that the fluid exits first pump stage [26] in a substantially axial flow. Second pressure sensor [34] measures the pressure of the wellbore fluid subsequent first pump stage [26] and prior to second pump stage [28]. The wellbore fluid then enters second pump stage [28], travels through another rotatable member [30*b*] and exits second pump stage [28]. Third pressure sensor [36] measures the pressure of the wellbore fluid as it is leaving second pump stage [28]. In the embodiment shown, the wellbore fluid exits special pump housing section [20] via outlet [24], where the fluid can then enter primary pump stages [17], and ultimately be pumped to the surface. Shaft [40] is connected to motor (not shown) and rotatable members [30*a,b*], and provides the necessary torque to rotate rotatable members [30*a,b*]. Spacer sleeves [44] provide structural support for special pump housing section [20].

Figure 4:
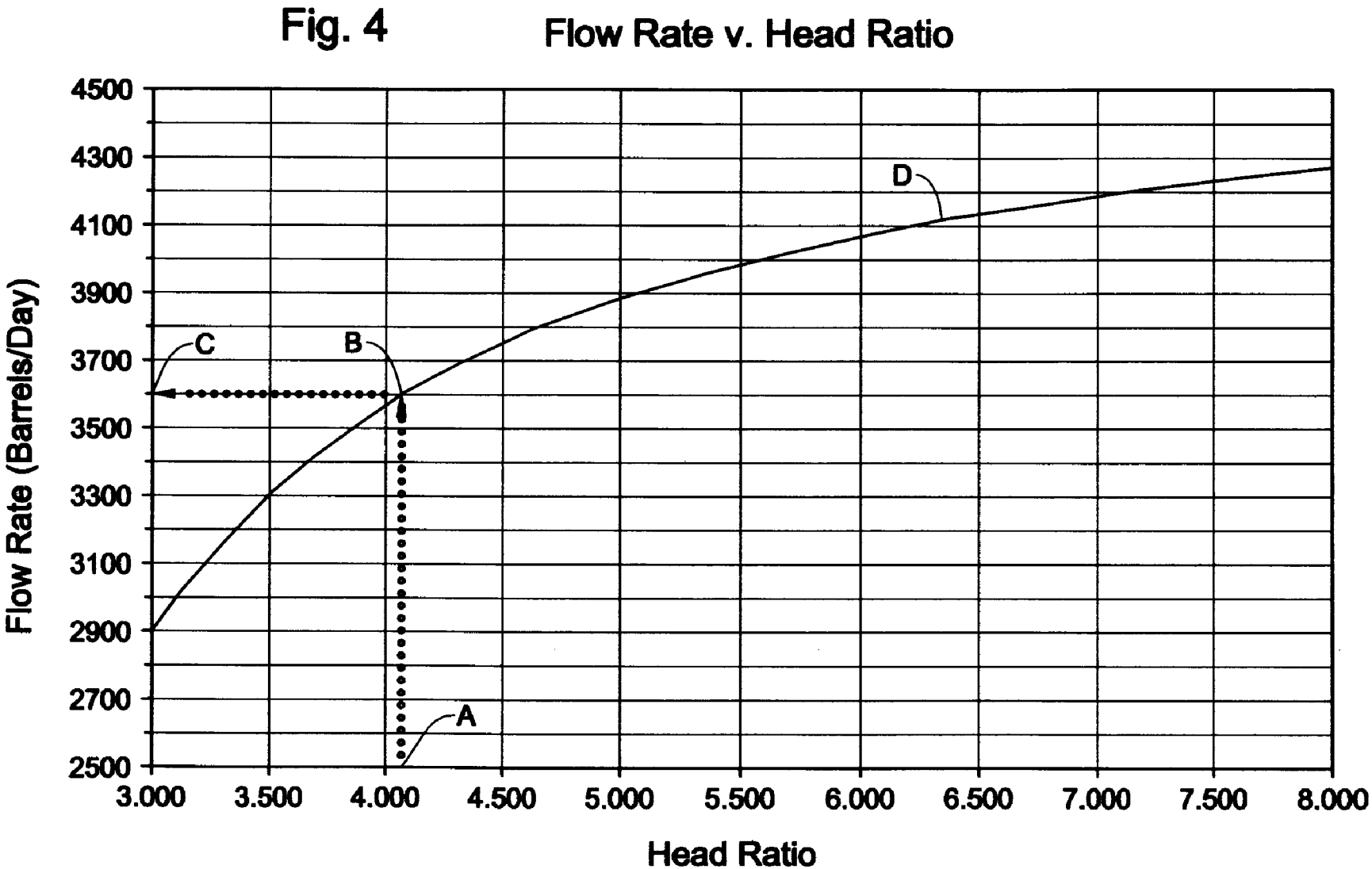
FIG. 4 is a graphical representation of the Flow Rate versus Head Ratio curve for two identified pump stages of FIG. 3.
Figure 5:
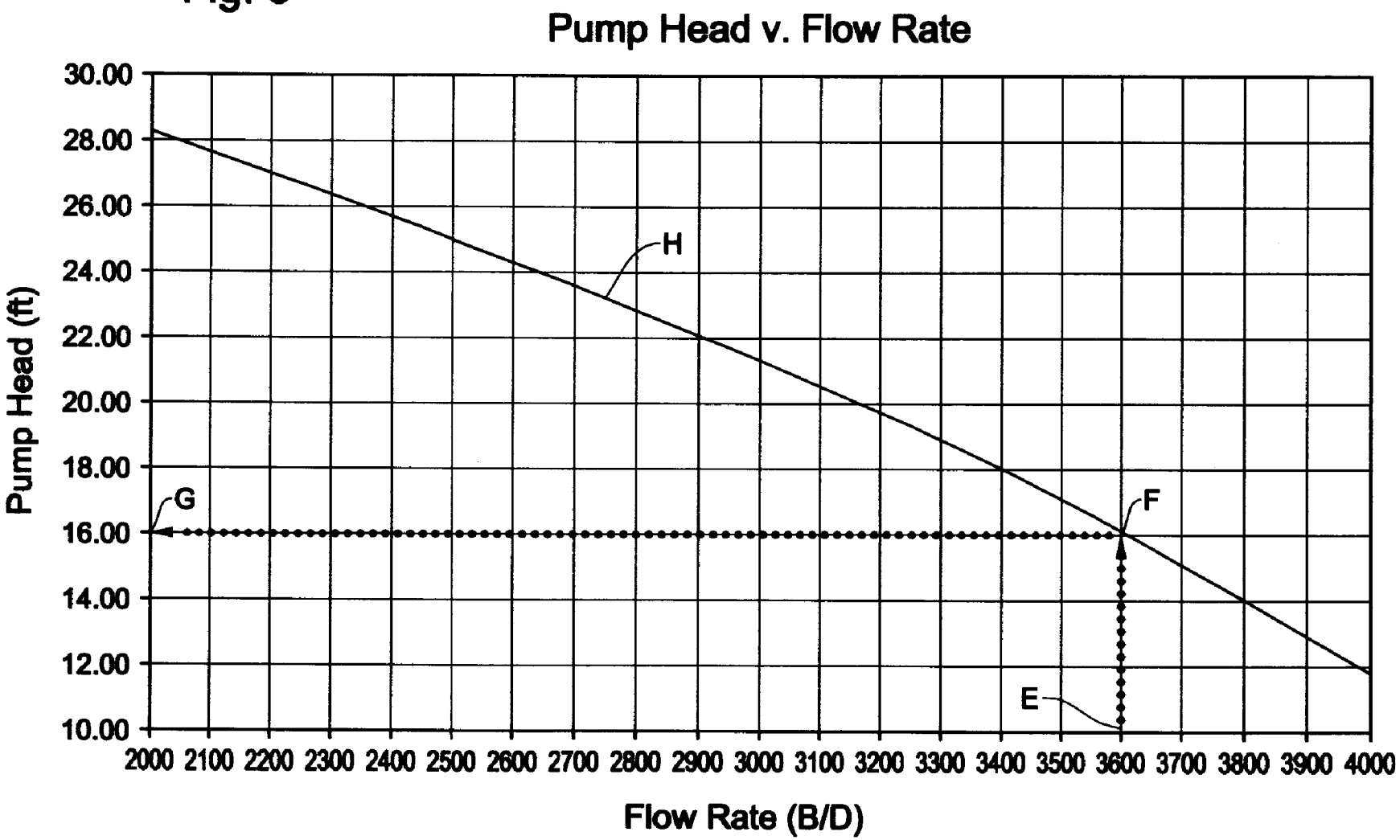
FIG. 5 is a graphical representation of the Head versus Flow Rate curve for one of the pump stages of FIG. 3.

FIG. 4 represents a pump curve of flow rate versus head ratio for a pair of pump stages. In one embodiment, the curve shown in FIG. 4 can be empirically prepared by measuring the head created for various flow rates for each pump stage, and then dividing the heads of each pump stage for each given flow rate to get the head ratio. In one embodiment, a user can create a pump curve of pump head versus flow rate for each pump stage, as shown in FIG. 5, with the pump curve of FIG. 5 being obtained through actual laboratory measurements of head produced at a given flow rate for a given pump stage. The embodiment further includes fitting a line of best fit for the curve shown in FIG. 5 for each pump stage, calculating a value for the head of each pump stage using the equation which describes the line of best fit, and calculating a head ratio for given flow rates as shown below in Table I below:

TABLE I

Calculation of Head Ratio

| Flow | Pump #1 Head | Pump #2 Head | H1/H2 |
|---|---|---|---|
| 1500 | 67.40 | 30.89 | 2.182 |
| 1600 | 67.28 | 30.43 | 2.211 |
| 1700 | 67.16 | 29.93 | 2.244 |
| 1800 | 67.05 | 29.41 | 2.280 |
| 1900 | 66.94 | 28.85 | 2.321 |
| 2000 | 66.84 | 28.26 | 2.365 |
| 2100 | 66.74 | 27.65 | 2.413 |
| 2200 | 66.65 | 27.02 | 2.466 |
| 2300 | 66.56 | 26.37 | 2.524 |
| 2400 | 66.47 | 25.70 | 2.586 |
| 2500 | 66.39 | 25.02 | 2.654 |

FIG. 5 only displays a pump curve for one of the pump stages for purposes of demonstration. In order to produce the curve shown in FIG. 4, a user would need to either develop pump curves as shown in FIG. 5 for both stages, or have a means for determining the head for each pump stage at a given flow rate. In a further embodiment, a user should develop these pump curves for viscosities that are expected to be encountered by the pressure sensors within the wellbore.

Pressure increase across a centrifugal pump stage is determined from Equation 1 below:

$$\Delta P = H \cdot SG \cdot k \tag{1}$$

wherein ΔP is the pressure increase across a pump stage, H is feet of head developed by the pump stage, SG is the specific gravity of the wellbore fluid, and k is a constant, which in the present case has a value of $$0.433\ \frac{lb_f}{(\mathrm{ft} * \mathrm{in}^2)}.$$

Therefore, the pressure increase across the first pump stage and the second pump stage can be expressed as:

$$\Delta P_1 = H_1 \cdot SG_1 \cdot k \tag{2}$$

$$\Delta P_2 = H_2 \cdot SG_2 \cdot k \tag{3}$$

respectively. Additionally, the pressure increase across the first and second pump stages can also be calculated according to the following equations:

$$\Delta P_1 = P_2 - P_1 \tag{4}$$

$$\Delta P_2 = P_3 - P_2 \tag{5}$$

Dividing Equation (4) by Equation (5) would yield:

$$\frac{\Delta P_1}{\Delta P_2} = \frac{(P_2 - P_1)}{(P_3 - P_2)} \tag{6}$$

Consequently, by dividing Equation (2) by Equation (3), and assuming that the specific gravity of the fluid is constant, we can find that the ratio of pressure increase is equivalent to the head ratio of each pump stage, as shown in Equation (7).

$$\frac{\Delta P_1}{\Delta P_2} = \frac{H_1}{H_2} \tag{7}$$

Of course one skilled in the art will recognize that it is irrelevant as to whether Eq. (2) was divided by Eq. (3) or vice versa. The only important feature is that a ratio of the pressure increases is calculated, and this ratio corresponds to the same notation used to construct the pump curve used to determine flow rate.

The assumption of a constant specific gravity is accurate as long as the pump stage heads are minimized (possible through design criteria) and there is substantially no free gas in the flow stream (application criteria).

For a given application, pump stages can be designed or selected so that the flow rate (Q) is a function of the head (and vice versa) over a known flow range. Through proper design, the flow rate can also be a function of the ratio of the stage heads, and is shown in the following equation:

$$Q = f\left(\frac{H_1}{H_2}\right) \tag{8}$$

Furthermore, substituting Equation (7) into Equation (8) yields the following equation:

$$Q = f\left(\frac{\Delta P_1}{\Delta P_2}\right) \tag{9}$$

Finally, substituting Equation (6) into Equation (9) yields the following equation:

$$Q = f\left(\frac{(P_2 - P_1)}{(P_3 - P_2)}\right) \tag{10}$$

Consequently, knowing a value for the ratio of the pressure increase across the stages yields a flow rate. Once a flow rate is determined, the head for a given pump stage can be determined since head and flow rate are a function of each other. Once the head has been determined, the specific gravity may be calculated using Equation (1), and solving for the only unknown value (SG).

The following is an example of how the flow rate and specific gravity would be determined. Suppose the device is constructed with a pump stage rated for flow at 11,000 barrels per day (B/D) as the first pump stage and a pump stage rated for flow at 3,000 B/D as the second pump stage. Furthermore, the pressures are measured using three pressure sensors, $P_1$, $P_2$, and P3, with $P_1$ at the inlet of the first pump stage, $P_2$ between the first and second pump stages, and $P_3$ being at the discharge of the second pump stage. The three recorded measurements are as follows:

$P_1$=100 psi; $P_2$=128.4 psi; $P_3$135.4 psi

According to Equation (6), the pressure increase ratio would be about 4.07. Using FIG. 4, one can find point A, and then move up vertically until hitting the plotted curve D. Next, a horizontal line is drawn from point B to the Y-axis (point C), which yields a value of 3600 barrels/day. This value is then used as the x-variable in FIG. 5 to determine the pump head in much the same way. In the present example, the user determines the corresponding Y-value for 3600. In one embodiment, the user determines where the point E intersects curve H (which is at point F). Next, a horizontal line is drawn from point F to the Y-axis (point G), which yields a value of about 16 ft of head. In the present embodiment, the pump curve in FIG. 5 is for the second pump stage. Therefore, in order to solve for the SG, Equation (3) must be used. In the present case, solving for the unknown specific gravity yields a value of 1.01.

In another embodiment, receiver [19] (FIG. 2) can contain stored data similar to that shown in Table I. In a preferred embodiment, the data includes pump data for a plurality of pump stages. In this embodiment, receiver [19] (FIG. 2) is capable of determining the head for each pump stage, as well as the head ratio without the need for an operator to visually examine a pump curve. Furthermore, the embodiment can include an executable which calculates the specific gravity of the wellbore fluid in using Equation (2) or (3). A further embodiment can include a viscosity measurement at the surface, followed by extrapolating to a viscosity value of the wellbore fluid based upon the temperature measurement provided by the sensor at the bottom of the motor. A further embodiment could include an iterative calculation such that the program uses the proper fluid data when constructing the pump curves shown in FIG. 4 and FIG. 5.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A method for determining wellbore parameters of a wellbore fluid flowing into a submersible pump having a plurality of pump stages comprising:

measuring a first pressure increase across a first pump stage of the submersible pump;

measuring a second pressure increase across a second pump stage of the submersible pump;

calculating a pressure increase ratio, wherein the pressure increase ratio is a ratio of the first pressure increase over the second pressure increase;

determining a flow rate based upon the pressure increase ratio;

determining a head of a selected one of the first and second pump stages based upon the flow rate; and calculating a specific gravity of the wellbore fluid using the determined head and the pressure increase of the selected one of the first and second pump stage.

2. The method of claim 1, wherein the wellbore fluid is substantially free of free gas.

3. The method of claim 1, wherein the step of determining the flow rate comprises:

obtaining a pump curve of flow rate versus head ratio for the first and second pump stages; and using the calculated pressure increase ratio to determine the flow rate of the wellbore fluid based upon the pump curve of flow rate versus head ratio, wherein the pressure increase ratio and head ratio are equivalent.

4. The method of claim 1, wherein the first pump stage comprises a first centrifugal pump stage and wherein the second pump stage comprises a second centrifugal pump stage.

5. The method of claim 1, wherein the first pump stage and the second pump stage are rated for different flow rates.

6. The method of claim 1, wherein the step of determining the head comprises obtaining a pump head versus flow rate curve for the selected one of the pump stages.

7. The method of claim 1, wherein the step of measuring a first pressure increase comprises:

(a) taking a pressure measurement of the wellbore fluid entering the first pump stage;

(b) taking a pressure measurement of the wellbore fluid exiting the first pump stage; and (c) calculating the pressure difference between steps (a) and (b).

8. The method of claim 1, wherein the step of measuring a second pressure increase comprises:

(a) taking a pressure measurement of the wellbore fluid entering the second pump stage;

(b) taking a pressure measurement of the wellbore fluid exiting the second pump stage; and (c) calculating the pressure difference between steps (a) and (b).

9. The method of claim 1, wherein the step of determining the flow rate of the wellbore fluid further comprises determining a viscosity of the wellbore fluid.

10. The method of claim 9, wherein the step of determining the viscosity of the wellbore fluid comprises:

measuring the viscosity of the fluid at a surface;

measuring a downhole temperature; and calculating the viscosity of the wellbore fluid downhole using measured viscosity at the surface and the measured downhole temperature.

11. A method for determining wellbore parameters of a wellbore fluid that is substantially free of free gas flowing into a centrifugal submersible pump comprising:

providing a first pump stage and a second pump stage of the submersible pump that are rated for different flow rates;

measuring a first pressure increase across the first pump stage of the submersible pump;

measuring a second pressure increase across the second pump stage of the submersible pump;

calculating a pressure increase ratio, wherein the pressure increase ratio is a ratio of the first pressure increase over the second pressure increase;

obtaining a pump curve of flow rate versus head ratio for the first and second pump stages;

using the calculated pressure increase ratio to determine a flow rate of the wellbore fluid based upon the pump curve of flow rate versus head ratio, wherein the pressure increase ratio and head ratio are equivalent;

determining a head of a selected one of the first and second pump stages based upon the flow rate; and calculating a specific gravity of the wellbore fluid using the determined head and the pressure increase of the selected one of the first and second pump stage.

12. The method of claim 11, wherein the step of measuring a first pressure increase comprises:

(a) taking a pressure measurement of the wellbore fluid entering the first pump stage;

(b) taking a pressure measurement of the wellbore fluid exiting the first pump stage; and (c) calculating the pressure difference between steps (a) and (b).

13. The method of claim 11, wherein the step of measuring a second pressure increase comprises:

(a) taking a pressure measurement of the wellbore fluid entering the second pump stage;

(b) taking a pressure measurement of the wellbore fluid exiting the second pump stage; and (c) calculating the pressure difference between steps (a) and (b).

14. A system for measuring and determining parameters within a wellbore comprising:

a submersible pump member, including an inlet for receiving fluid and an outlet for discharging fluid, disposed within the wellbore and including two pump stages, wherein each pump stage includes a moveable member for moving said fluids;

three pressure sensors, wherein the three pressure sensors are placed such that the three pressure sensors, in combination with each other, are operable to measure the pressure increase before and after each of the two pump stages;

a receiver communicatively coupled to and receiving data from the three pressure sensors, wherein said receiver determines the specific gravity of fluids within the wellbore according to the method of claim 1.

15. The system of claim 14, further comprising an electrically-powered motor located in a remote downhole location within the wellbore mechanically coupled to the moveable member of each pump stage.

16. The system of claim 15, further comprising an electrical conductor member extending from a remote surface location to the electric submersible pump for providing electrical power to the electrically-powered motor, wherein the data is superimposed on the electrical conductor member.

17. The system of claim 14, wherein the moveable member of each stage is a rotatable impeller.

18. The system of claim 14, further comprising three or more spacer sleeves, wherein one of the spacer sleeves is positioned below the pump stages, one of the spacer sleeves is positioned above the pump stages, and one of the spacer sleeves is positioned between the pump stages, wherein each of the pressure sensors is fixedly attached to one of the spacers such that the pressure sensors are operable to measure the pressure increase across each pump stage.

19. The system of claim 14, wherein the two pump stages are rated for different flow rates.

20. The system of claim 14, wherein the two pump stages are adjacent to each other with no other pump stages disposed in between.

* * * * *